US006540092B2

(12) United States Patent
Sirois

(10) Patent No.: US 6,540,092 B2
(45) Date of Patent: Apr. 1, 2003

(54) FIREARM COMPONENT STORAGE ADAPTER

(75) Inventor: Michael A. Sirois, Dover, NH (US)

(73) Assignee: On Target Technologies, Dover, NH (US)

( * ) Notice: Subject to any disclaimer, the term of this patent is extended or adjusted under 35 U.S.C. 154(b) by 0 days.

(21) Appl. No.: 10/010,598

(22) Filed: Oct. 26, 2001

(65) Prior Publication Data

US 2002/0074298 A1 Jun. 20, 2002

Related U.S. Application Data

(63) Continuation-in-part of application No. 09/705,081, filed on Nov. 2, 2000, now Pat. No. 6,364,135.

(51) Int. Cl.[7] ..... A47F 5/00
(52) U.S. Cl. ..... 211/64; 248/291.1
(58) Field of Search ..... 211/64, 100, 113, 211/70.6, 60.1; 248/291.1, 292.14, 294.1, 317, 340, 341, 309.1; 224/913; 42/94, 95

(56) References Cited

U.S. PATENT DOCUMENTS

| | | | | |
|---|---|---|---|---|
| 945,520 | A | | 1/1910 | Greenwood |
| 1,584,722 | A | * | 5/1926 | Bohmbach |
| 1,892,687 | A | * | 1/1933 | Teufel |
| 2,423,531 | A | * | 7/1947 | Theis |
| 3,964,613 | A | | 6/1976 | Anderson, Jr. |
| 4,226,399 | A | | 10/1980 | Henderson |
| 4,673,148 | A | * | 6/1987 | Oliver |
| 4,807,381 | A | | 2/1989 | Southard |
| 4,873,777 | A | | 10/1989 | Southard |
| 4,949,559 | A | | 8/1990 | Glines |
| 4,971,208 | A | | 11/1990 | Reinfried, Jr. et al. |
| 5,050,331 | A | | 9/1991 | Burkhalter |
| 5,058,302 | A | | 10/1991 | Minneman |
| D346,003 | S | | 4/1994 | Anderson |
| D359,392 | S | | 6/1995 | Bellington |
| 5,600,913 | A | | 2/1997 | Minneman |
| 5,682,700 | A | | 11/1997 | Sandberg |
| 5,855,348 | A | * | 1/1999 | Fornara ..... 248/291.1 |
| 6,047,870 | A | * | 4/2000 | Morford ..... 211/64 X |
| D426,612 | S | | 6/2000 | Primeau, IV |
| 6,360,931 | B1 | * | 3/2002 | Morford ..... 211/64 X |
| 6,364,135 | B1 | * | 4/2002 | Sirois et al. ..... 211/64 |

* cited by examiner

*Primary Examiner*—Robert W. Gibson, Jr.
(74) *Attorney, Agent, or Firm*—Pierce Atwood; Kevin M. Farrell

(57) ABSTRACT

The present invention relates to an storage adapter used for engaging and supporting the stock/frame assembly of both the Contender® or Encore® brands of Thompson/Center Arms, Inc.® firearms. In a preferred embodiment of the present invention, the stock/frame assembly is stored in a vertical position above the floor of the gun cabinet/safe through the use of two individual components: (i) a novel storage adapter and (ii) a storage receiver which was previously-disclosed in U.S. patent application Ser. No. 09/705,081. The storage adapter component is comprised of a first end and a second end. The storage adapter engages, supports, and secures the stock/frame assembly by making use of the hinge pin of the firearm and a securing means (preferably a securing strap) to secure the stock/frame assembly to the second end of the storage adapter. The storage adapter, by use of a hanging means (preferably a hanging pin) in its first end, is then placed into (i.e., hung-on) the previously-disclosed, wall-mountable storage receiver component. By storing the stock/frame assembly in such a secured vertical position above the floor of the gun cabinet/safe it is far less likely that the stored assembly will be jarred (i.e., potentially damaging or marring the various internal and external mechanical components and/or the finish/petina of the stock materials) or otherwise damaged by, e.g., a heavy object falling on said assembly.

40 Claims, 2 Drawing Sheets

FIREARM COMPONENT STORAGE ADAPTER

RELATED APPLICATIONS

The present application claims priority to, and is a Continuation-in-Part of U.S. patent application Ser. No. 09/705,081, filed Nov. 2, 2000, Notice of Allowance received Aug. 23, 2001, now U.S. Pat. No. 6,364,135 and entitled "Gun Barrel Holder and Support Base", whose disclosure is incorporated herein by reference in its entirety.

BACKGROUND OF THE INVENTION

Certain firearms have the ability to be "broken-down", that is the barrel is separated from the stock/frame assembly. For example, Thompson/Center Arms, Inc.® (Rochester, N.H.) manufactures a line of rifles and handguns that permits the user to interchange barrels of differing calibers and lengths on a single stock/frame assembly.

The ability to interchange barrels allows a hunter to utilize a single stock/frame assembly while concomitantly providing the flexibility of being able to use different barrel lengths and/or caliber ammunition depending upon the specific type of game being hunted. Similarly, for a target shooter, this interchangeability allows the shooter to interchange barrels of varying lengths and calibers depending upon the target distance, type of targets being shot, and the shooter's individual preferences. Although the flexibility to interchange barrels and calibers has the advantages described above, it also presents a number of disadvantages to the owner of the weapon.

Thompson/Center Arms, Inc.® manufactures two types of firearms, the Contender® and Encore®, which can be separated into two components—a barrel and a stock/frame assembly. However, due to the extensive selection of different caliber/length barrels available through the manufacturer, the owner of such firearms can quickly amass a large number of different components which must be safely and conveniently stored. Such storage of the stock/frame assembly, following its separation from the barrel, is, at-best, problematic.

Unfortunately, there is no "standard" method for storing such a separated stock/frame assembly. For example, the stock/frame assembly can be placed into a "soft case" fabricated from material (e.g., cotton, nylon, fleece, and the like) that protects the outer surface of the stock/frame assembly from being marred. The "soft case" is then generally placed either upright in a corner, or lying on the floor of a gun cabinet/safe. While storage of the stock/frame assembly in such a soft case protects the outer surface of the assembly, it increases the probability of the assembly being subjected to other types of potential damage.

For example, enclosing the stock/frame assembly in the soft case tends to promote corrosion due to the lack of air circulation and/or the trapping of humid air or moisture therein. Additionally, a stock/frame assembly leaning against the corner or lying on the floor of a gun cabinet/safe may also fall or get hit by a falling weight (e.g., by another stored stock/frame assembly or barrel), which has the potential of causing damage to the assembly. Gun manufacturers warn gun users that a stock/frame assembly that has been struck in this manner must, be inspected prior to use, so as to assure that there is no structural damage to the assembly (i.e., especially to the receiver area which is subjected to extremely high pressure during the firing of the weapon). Failure to perform such an inspection can result in serious or fatal injury to the shooter and/or a bystander.

Moreover, various critical, internal and external mechanical components of the firearm (e.g., hammer, firing pin, chamber, etc.) which are located on or within the frame element can be damaged if improperly stored.

With respect to aesthetics, many owners select expensive and rare grades of wood for the stock of the stock/frame assembly. Some firearm owners also purchase after-market stocks which have been hand-engraved or supplied with intricate inlays. Improper storage can therefore cause marring of the stock's finish. Additionally, improper storage can also lead to warping of the stock's wood. Warping can markedly effect the accuracy of the firearm due to improper alignment of the frame element within the stock/frame assembly. If the frame and barrel elements are not properly aligned a hunter could discharge the firearm with the resulting shot missing its intended target. The missed shot also has the potential of damaging private property or hitting a bystander. Similarly, such misalignment can markedly effect a target shooters score.

Finally, the currently-utilized methods of storage for such stock/frame assemblies are inefficient, in that they do not allow instant identification of the specific stock/frame assembly which is stored. They also do not maximize the use of space within the gun cabinet/safe.

Therefore, there remains an, as yet, unfulfilled need for the development of a firearm component holder and support that allows proper storage of the stock/frame assembly from the Contender® and/or Encore® brands of Thompson/Center Arms, Inc.® firearms within a gun cabinet/safe that functions: (i) to mitigate the risk that the stock/frame assembly will be damaged; (ii) to mitigate the risk that of possible damage to the various mechanical components (e.g., hammer) of the firearm; and (iii) to allow instant identification of the individual assembly which is being stored.

SUMMARY OF THE INVENTION

Figure 1:
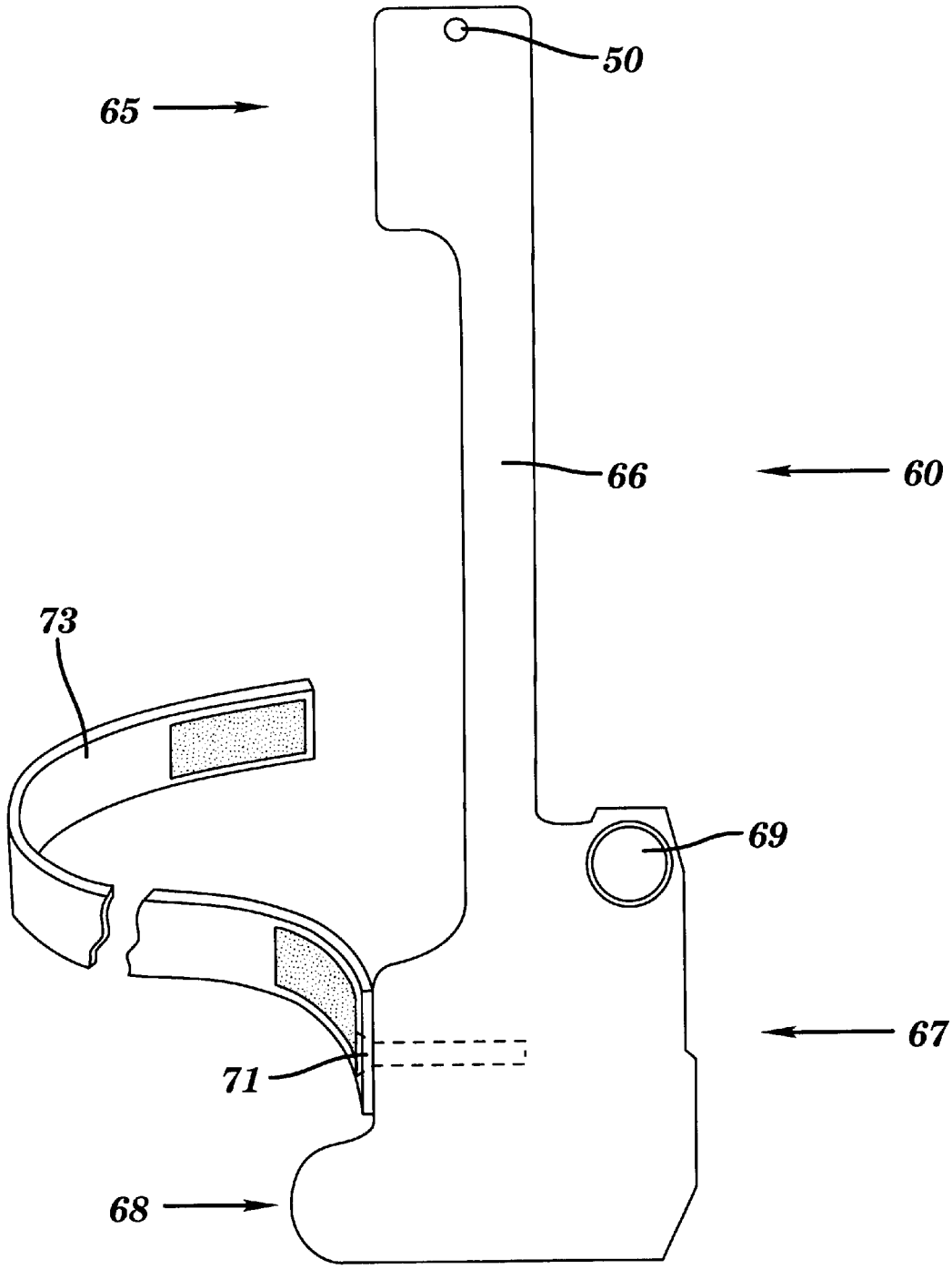
FIG. 1: illustrates a side-view of the storage adapter of the present invention used to support and store a stock/frame assembly from Contender® or Encore® brands of Thompson/Center Arms, Inc.® firearms.

The present invention relates to an storage apparatus for the support and storage of a stock/frame assembly from Contender® or Encore® brands of Thompson/Center Arms, Inc.® firearms, that has been separated from the barrel, in a position that markedly reduces the likelihood of the aforementioned component being damaged during storage. The storage apparatus of the present invention is designed to be installed into a pre-existing gun cabinet/safe or, alternately, to be installed by gun cabinet/safe manufacturers during assembly.

In a preferred embodiment of the present invention, the storage apparatus which supports and stores the stock/frame assembly in a vertical position above the floor of the gun cabinet/safe comprises two individual components: (i) a novel storage adapter; and (ii) a storage receiver which was originally-disclosed in U.S. patent application Ser. No. 09/705,081. In brief, the storage adapter component engages and supports the stock/frame assembly by making use of the hinge pin of the firearm and a securing strap to secure the assembly to the storage adapter. The storage adapter, by use of a hanging means (e.g., a hanging pin) in its first region, is then placed into (i.e., hung-on) the previously-disclosed, wall-mountable storage receiver component. By storing the stock/frame assembly in such a secured vertical position above the floor of the gun cabinet/safe, it is far less likely that the stored assembly will be jarred, potentially damaging the various internal mechanical components (e.g., the hammer mechanism), or otherwise damaged by, e.g., a heavy object falling on said assembly.

DETAILED DESCRIPTION OF THE INVENTION

Thompson/Center Arms, Inc.® (Rochester, N.H.) manufactures a line of rifles and handguns that permits the user to interchange barrels of differing calibers and lengths on a single stock/frame assembly. Over 200 calibers and barrels ranging in length from 6–26 inches are available through this manufacturer. In addition, by use of a barrel of sufficient length, and by mounting a buttstock (i.e., a section of stock which mounts to the rear of the frame element and extends under the barrel element) thereto, the firearm owner may interchange between a handgun and rifle without need to change the frame element. The Thompson/Center Arms, Inc.® firearms are comprised of a stock/flame assembly (comprising a stock element and a frame element) which is separable from a barrel element.

The storage apparatus which supports and stores the stock/frame assembly in a vertical position above the floor of the gun cabinet/safe comprises two individual components: (i) a novel storage adapter of the present invention; and (ii) a storage receiver which was originally-disclosed in U.S. patent application Ser. No. 09/705,081. Thus, the present invention relates to a storage adapter that allows the stock/frame assembly of the Contender® and Encore® brands of Thompson/Center, Inc.® firearms, when separated from the barrel, to be stored in a vertical orientation in a gun cabinet/safe. As previously discussed, the storage adapter of the present invention is designed to engage and be supported by the storage receiver disclosed in U.S. patent application Ser. No. 09/705,081. This storage receiver, while originally designed to support the lug-end of a separated barrel of the Contender and Encore brands of Thompson/Center, Inc. firearms, is capable of being adapted to engage and support the stock/frame assembly storage adapter of the present invention. Before disclosing the storage adapter, the storage receiver disclosed in U.S. patent application Ser. No. 09/705,081 will be discussed below.

In brief, the aforementioned storage receiver comprises a blank manufactured from any type of workable material (e.g., metals, plastic, composite materials or ceramics), although aluminum is preferred. A slot is provided in the blank that is wide enough to accommodate the stock/frame assembly storage adapter of the present invention. In the preferred embodiment, the slot should have a width of approximately 0.505 inches to accommodate the Contender® stock/frame assembly storage adapter, and should have a width of approximately 0.625 inches to accommodate the Encore® stock/frame assembly storage adapter. Additionally, a pair of pin slots, disposed along the perimeter of the slot, are also provided. The inner edge region of these pin slots have a shoulder which engages the hanging pin of the stock/frame assembly storage adapter of the present invention (which will be discussed below). An attachment hole is provided in the base of the blank to allow the storage receiver to be mounted to a vertical surface, e.g., a wall within a gun cabinet/gun safe. Moreover, in a preferred embodiment, there is a male end and a female end located at opposing ends of the blank to allow a plurality of storage receivers to be mounted in series.

The stock/frame assembly storage adapter of the present invention comprises two opposing ends: (i) a first end—which comprises a hanging means (preferably a hanging pin) designed to engage the pin slot in the previously-disclosed storage receiver; and (ii) and a second end—which engages, supports, and secures the stock/frame assembly. These opposing ends are connected by a central extension portion of varying length.

The second end of the storage adapter is sized so as to avoid contact with the locking mechanism of the stock/frame assembly when in use, where the locking mechanism functions to reversibly-engage the barrel lug of the barrel element when the firearm is assembled and the barrel element is pivoted into a firing position. Proper sizing allows the second end to engage this area of the stock/frame assembly without risk of marring or otherwise damaging the weapon. The second end of the storage adapter additionally makes use of the hinge pin of the firearm and a retaining means to secure the stock/frame assembly to the storage adapter. The hinge pin is a large diameter pin that is inserted through a hole which passes entirely through the frame of the weapon. When inserted into this aperture, the hinge pin serves both as a pivot when "breaking open" the weapon for loading or cleaning purposes and as a securing device to secure the barrel to the stock/frame assembly.

The storage adapter of the present invention, by use of a hanging means (e.g., a hanging pin) in its first region, is then placed into the wall-mountable storage receiver component. The opposing first and second ends of the storage adapter are connected by a central extension portion of varying lengths, depending upon the mounting configuration of the wall-mounted receivers (i.e., standard or staggered), the length of the stored barrels, and the like. In preferred embodiments, the total length of the storage adapter of the present invention is approximately 4 inches and approximately 6 inches. In another preferred embodiment, the storage adapters of the present invention that are utilized with either the Contender® or Encore® brands of Thompson/Center, Inc.® firearms are differentiated by, e.g., anodizing the components a gold and black color, respectively.

The storage adapter of the present invention thus provides: (i) a means to properly and securely organize, support, and store the separated stock/frame assembly and its various associated components; (ii) a means of to properly organize, safely store, and protect the various internal and external mechanical components (e.g., the hammer) of the frame element when not in use; and (iii) a means to allow instant identification of the individual stock/frame assembly which is being stored.

Advantages of the present invention include, but are not limited to: (i) protecting an investment in expensive firearm components by allowing them to be vertically supported in a gun cabinet/safe; (ii) allowing the gun owner to store separated stock/frame assemblies in a gun cabinet/safe in a fully-exposed manner; (iii) not having to place the separated stock/frame assembly into a "soft case", which promotes corrosion; (iv) the actual weight of the stock/frame assemblies helps to hold them in place in the apparatus of the present invention; and (v) the individual storage receiver components of the present invention can be interlocked together allowing the stock/frame assemblies to be stored in as little space as approximately 4 inches if mounted on-center and approximately 2 inches if staggered mounting row is used.

Figure 2:
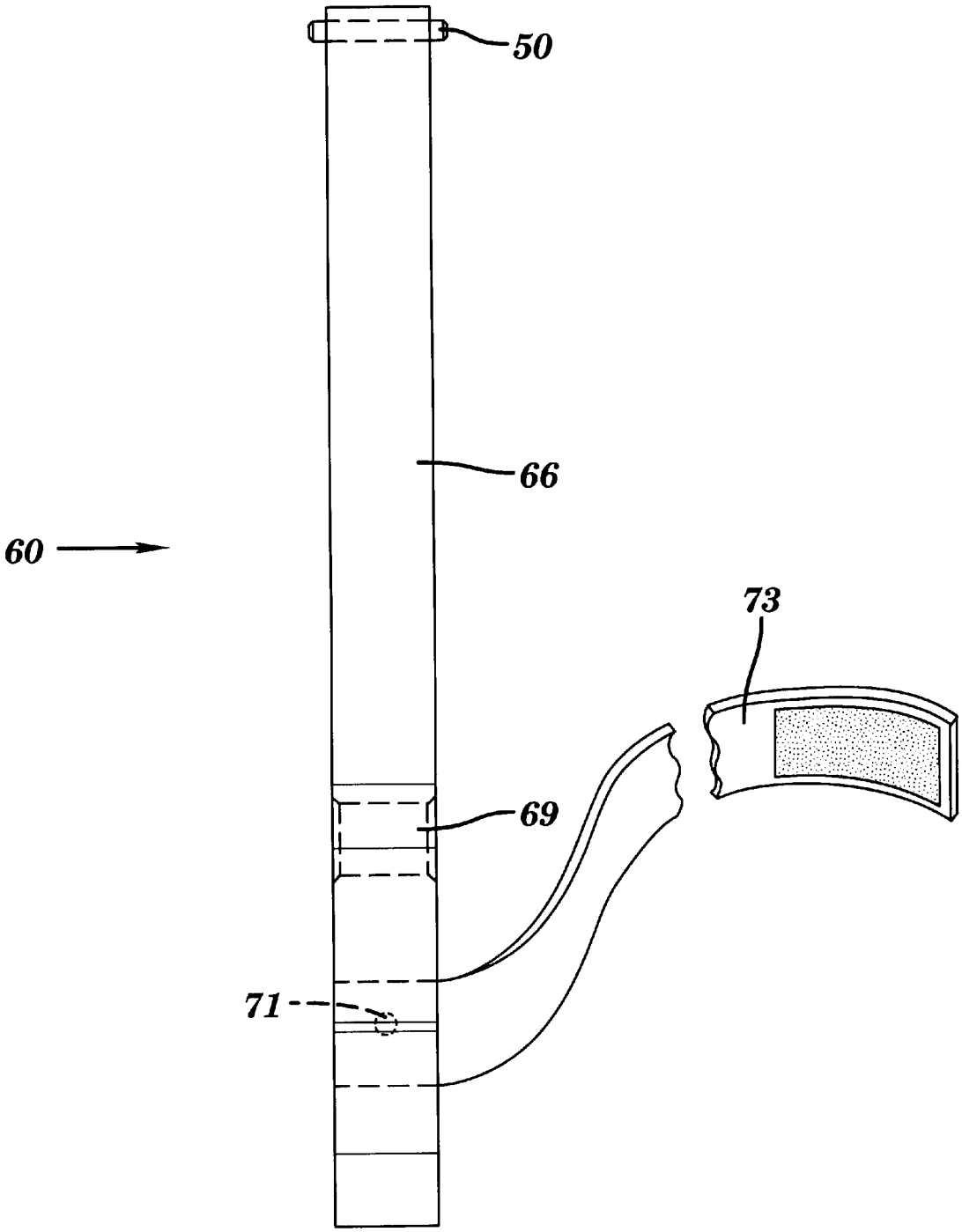
FIG. 2: illustrates an edge-view of the storage adapter of the present invention used to support and store a stock/frame assembly from Contender® or Encore® brands of Thompson/Center Arms, Inc.® firearms.

FIG. 1 and FIG. 2 illustrate a preferred embodiment of a storage adapter 60 used to engage, support, and store a stock/frame assembly from Contender® or Encore® brands of Thompson/Center Arms, Inc.® firearms. A blank 63 is initially manufactured out of any workable material. Depending upon the specific method of manufacture, the preferred material is 6061 alloy aluminum if the holder is to be machined, and 380 alloy if the holder is to be cast. While anodized aluminum is the preferred material, other materials such as other workable metals, plastic, composite materials or ceramics can also be used. The blank 63 is fabricated from either 0.50 inch or 0.625 inch thick stock for the use with the stock/frame assembly from Contender® or Encore® brands of Thompson/Center Arms, Inc.® firearms, respectively.

In a preferred embodiment, the total lengths of the stock/frame assembly storage adapter 60 used with both Contender® or Encore® brands of Thompson/Center Arms, Inc.® firearms should be approximately 4.0 inches or approximately 6.0 inches, depending upon the specific mounting configuration of the plurality of wall-mounted storage receivers (i.e., standard or staggered), the length of the stored barrels, and the like. However, one skilled in the arts will again recognize that the total length of the stock/frame assembly storage adapter 60 can be varied and still remain functional.

The stock/frame assembly storage adapter 60 is comprised of two ends—a first end 65 and a second end 67. A central extension portion 66 provides appropriate spacing between the first end 65 and second end 67. The length of this central extension portion 66 varies as a function of the specific mounting configuration of the plurality of wall-mounted storage receivers (i.e., standard or staggered), the length of the stored barrels, and the like.

In a preferred embodiment, the first end 65 comprises a hanging means, e.g., a hanging pin 50, which projects laterally from either side of the stock/frame assembly storage adapter 60. It should be noted, however, that the hanging means encompasses a variety of alternative means (e.g., rectangular projections, and the like). The hanging pin 50 is manufactured out of metal (e.g., brass, aluminum, and the like) or any other workable material. The hanging pin 50, preferably, should be approximately 0.125 inches in diameter and 0.8 inches in overall length. In this preferred embodiment, the first end 65 of the stock/frame assembly storage adapter 60 is dimensioned such that it provides a non-friction fit into the slot of the storage receiver originally-disclosed in U.S. patent application Ser. No. 09/705,081. As previously discussed, the slot in the storage receiver should have an overall width of approximately 0.505 inches to accommodate the Contender® stock/frame assembly storage adapter 60, and should have an overall width of approximately 0.625 inches to accommodate the Encore® stock/frame assembly storage adapter 60. The hanging pin 50 of the first end 65 is then engaged within the storage receiver's pin slots, disposed along the perimeter of the slot, so as to secure and support the stock/frame assembly storage adapter 60 placed therein. Although, in order to properly engage the hanging pin 50 of the preferred embodiment, the storage receiver's pin slots should be machined into the storage receiver to a width of approximately 0.187 inches and a depth of approximately 0.156 inches, one skilled in the art will recognize that the machined depth of the pin slots can be varied through a relatively wide range without adversely affecting the functionality of the storage receiver in engaging and securing the hanging pin 50 of the stock/frame assembly storage adapter 60. Similarly, each of the storage receiver's pin slots should have a length of approximately 0.4 inches measured from the center of the slot (giving a total length of approximately 0.8 inches), so as to allow proper engagement of the hanging pin 50. However, one skilled in the arts will again recognize that the storage receiver's pin slots can be longer and still remain functional.

In a preferred embodiment, the second end 67 of the stock/frame assembly storage adapter 60 functions to engage, secure, and support the stock/frame assembly of both the Contender® or Encore® brands of Thompson/Center Arms, Inc.® firearms. The stock/frame assembly is secured and supported by the second end 67 of the stock/frame assembly storage adapter 60 by several means. First, the second end 67 of the storage adapter 60 is sized so as to avoid contact with the locking mechanism of the stock/frame assembly when in use. The locking mechanism is internally located in the stock/frame assembly where it functions to reversibly-engage the barrel lug of the barrel element when the firearm is assembled and the barrel element is pivoted into a firing position. Proper sizing allows the second end 67 to engage this area of the stock/frame assembly without risk of marring or otherwise damaging the weapon. It should be noted however that both the overall size and shape of the second end 67 may be varied in a reasonable manner without effecting its functionality.

Additionally, the second end 67 also provides a stand-off element 68 which functions to prevent direct contact between any portion of the stock/frame assembly, including, e.g., the hammer mechanisms, with any vertical surface to which the storage receiver is mounted. In addition, when storage receiver is attached to the substantially vertical surface, the stand-off element also functions to keep the major axis of the central extension 66 portion of the storage adapter 60 substantially parallel with the vertical surface to which the storage receiver is mounted when the storage adapter 60 is hung thereon. Second, an aperture 69, extending through the thickness of the blank 63 and located in the upper region of the second end 67, is provided. The aperture 69 is of sufficient diameter to allow the hinge pin of the firearm to pass therethrough without undue friction. The firearm's hinge pin is a large diameter pin that is inserted through a hole which passes entirely through the frame of the weapon. When inserted into this hole, the hinge pin serves, both as a pivot when "breaking open" the weapon for loading or cleaning purposes, and as a securing device to secure the barrel to the stock/frame assembly. Similarly, the hinge pin, when inserted into the aperture 69 of the storage adapter 60, serves to further aid in the securing of the stock/frame assembly to the storage adapter. In a preferred embodiment, the aperture 69 should be approximately 0.376 inches and approximately 0.4385 inches in diameter to engage the hinge pins of, and further secure and support the stock/frame assembly of the Contender® and Encore® brands of Thompson/Center Arms, Inc.® firearms, respectively. Third, the second end 67 also comprises a retaining means which further secures the stock/frame assembly to the storage adapter 60, as well as keeping said storage adapter in a storage position, where the storage position is a position in which the major axis of the central extension portion 66 of the storage adapter 60 is substantially parallel with what would be the major axis of the barrel element in an assembled firearm assembly (i.e., the stock/frame assembly and the barrel element engaged with one another to form a functional firearm). Thus, when the stock/frame assembly is mounted in the storage adapter 60 with both the retaining means and hinge pin engaged, the retaining means serves to prevent the stock/frame assembly from being able to pivot using the hinge pin as an axis.

For example, the retaining means may, preferably, comprise a retaining strap (not shown) which is secured to the storage adapter 60 by the use of a fastening device (e.g., a screw) inserted into a tapped hole. In a preferred embodiment of the present invention, the tapped hole 71 is approximately 0.125 inches in diameter and approximately 0.75 inches in depth and is located on the edge of the stock/frame assembly storage adapter 60. One skilled in the art will recognize, however, that a tapped hole of differing diameter or depth may also be utilized with no effect appreciable on the functionality of the stock/frame assembly storage adapter 60. A screw or other fastening device (not shown) of the proper diameter and thread-pitch is then inserted into the tapped hole 71 where it serves to fix, e.g., a securing strap. The securing strap is comprised of, e.g., hook-and-loop fastener (VELCRO®) or an elasticized material of sufficient length to completely surround the circumference of the stock/frame assembly placed in the stock/frame assembly storage adapter 60. As the securing strap 73 serves to secure the stock/frame assembly to the storage adapter in a vertical orientation, it greatly mitigates any lateral movement and thereby prevents damage to said assembly.

EQUIVALENTS

It should be noted that the present invention is not to be limited in scope by the specific embodiments described herein. Moreover, various modifications of the present invention in addition to those described herein will become apparent to those skilled in the art from the foregoing descriptions and accompanying figures. Such modifications are intended to fall within the scope of the appended claims.

What is claimed is:

1. A storage adapter for a firearm assembly, the firearm assembly comprising a stock/frame assembly and a barrel element, said stock/frame assembly further comprising a hinge pin, the barrel element further comprising a barrel lug adapted for pivotal engagement of the stock/frame assembly about the hinge pin, said storage adapter comprising:

a) a first end adapted for engaging a storage receiver;

b) a central extension portion for providing appropriate spacing between the first end and the stock/frame assembly when in use;

c) a second end adapted for pivotal engagement of the stock/frame assembly about the hinge pin.

2. The storage adapter of claim 1, wherein said storage adapter is constructed from a material selected from the group consisting of: metal, ceramic, composite materials, and hard plastic.

3. The storage adapter of claim 2, wherein said storage adapter is constructed from aluminum.

4. The storage adapter of claim 3, wherein said aluminum is anodized.

5. The storage adapter of claim 1, wherein said storage adapter has a thickness of approximately 0.50 inches.

6. The storage adapter of claim 1, wherein said storage adapter has a thickness of approximately 0.625 inches.

7. The storage adapter of claim 1, wherein said storage adapter has an overall length of approximately 4 inches.

8. The storage adapter of claim 1, wherein said storage adapter has an overall length of approximately 6 inches.

9. The storage adapter of claim 1, wherein said first end further comprises a hanging means, said hanging means being sized for accommodation by pin slots in the storage receiver.

10. The storage adapter of claim 9, wherein said hanging means is a hanging pin which protrudes from two sides of the storage adapter, said hanging pin being sized for accommodation by pin slots in the storage receiver.

11. The storage adapter of claim 10, wherein said hanging pin is constructed from a material selected from the group consisting of: metal, ceramic, composite materials, and hard plastic.

12. The storage adapter of claim 1, wherein said second end further comprises an aperture which accepts the hinge pin of the stock/frame assembly.

13. The storage adapter of claim 12, wherein said aperture is approximately 0.376 inches in diameter.

14. The storage adapter of claim 12, wherein said aperture is approximately 0.4385 inches in diameter.

15. The storage adapter of claim 1, wherein said stock/frame assembly further comprises a locking mechanism for reversibly engaging the barrel lug when the barrel is pivoted into a firing position, said storage adapter being sized to avoid contact with the locking mechanism of the stock/frame assembly when in use.

16. The storage adapter of claim 1, wherein said second end further comprises a stand-off element which prevents direct contact between any portion of the stock/frame assembly with a substantially vertical surface to which the storage receiver is attached.

17. The storage adapter of claim 16, wherein said stand-off element is sized such that, when in use and hung from a storage receiver attached to the substantially vertical surface, the major axis of the central extension portion is substantially parallel with the substantially vertical surface.

18. The storage adapter of claim 1, wherein said second end further comprises a retaining means which functions to secure the stock/frame assembly to the storage adapter and to secure the storage adapter in a storage position, said storage position being that position in which the major axis of the central extension portion is substantially parallel with the major axis of the barrel element in the firearm assembly.

19. The storage adapter of claim 18, wherein said retaining means comprises a strap.

20. The storage adapter of claim 19, wherein said strap is fabricated from a material selected from the group consisting of: a hook-and-loop fastener, an elasticized material, and a rubberized material.

21. A method for the storage for a firearm assembly comprising a stock/frame assembly and a barrel element, said stock/frame assembly further comprising a hinge pin, said barrel element further comprising a barrel lug adapted for pivotal engagement of the stock/frame assembly about the hinge pin, said method of storage comprising:

a) providing a storage adapter comprising
   i) a first end adapted for engaging a storage receiver;
   ii) a central extension portion for providing appropriate spacing between the first end and the stock/frame assembly when in use; and
   iii) a second end adapted for pivotal engagement of the stock/frame assembly about the hinge pin;

b) engaging the storage adapter with the stock/frame assembly about the hinge pin; and c) changing the assembly of step b from the storage receiver by engaging the first end of the storage adapter and the storage receiver.

22. The method for the storage for a firearm assembly of claim 21, wherein said storage adapter is constructed from a material selected from the group consisting of: metal, ceramic, composite materials, and hard plastic.

23. The method for the storage for a firearm assembly of claim 22, wherein said storage adapter is constructed from aluminum.

24. The method for the storage for a firearm assembly of claim 23, wherein said aluminum is anodized.

25. The method for the storage for a firearm assembly of claim 21, wherein said storage adapter has a thickness of approximately 0.50 inches.

26. The method for the storage for a firearm assembly of claim 21, wherein said storage adapter has a thickness of approximately 0.625 inches.

27. The method for the storage for a firearm assembly of claim 21, wherein said storage adapter has an overall length of approximately 4 inches.

28. The method for the storage for a firearm assembly of claim 21, wherein said storage adapter has an overall length of approximately 6 inches.

29. The method for the storage for a firearm assembly of claim 21, wherein said first end further comprises a hanging means, said hanging means being sized for accommodation by pin slots in the storage receiver.

30. The method for the storage for a firearm assembly of claim 29, wherein said hanging means is a hanging pin which protrudes from two sides of the storage adapter, said hanging pin being sized for accommodation by pin slots in the storage receiver.

31. The method for the storage for a firearm assembly of claim 30, wherein said hanging pin is constructed from a material selected from the group consisting of: metal, ceramic, composite materials, and hard plastic.

32. The method for the storage for a firearm assembly of claim 21, wherein said second end further comprises an aperture which accepts the hinge pin of the stock/frame assembly.

33. The method for the storage for a firearm assembly of claim 32, wherein said aperture is approximately 0.376 inches in diameter.

34. The method for the storage for a firearm assembly of claim 32, wherein said aperture is approximately 0.4385 inches in diameter.

35. The method for the storage for a firearm assembly of claim 21, wherein said stock/frame assembly further comprises a locking mechanism for reversibly engaging the barrel lug when the barrel is pivoted into a firing position, said storage adapter being sized to avoid contact with the locking mechanism of the stock/frame assembly when in use.

36. The method for the storage for a firearm assembly of claim 21, wherein said second end further comprises a stand-off element which prevents direct contact between any portion of the stock/frame assembly with a substantially vertical surface to which the storage receiver is attached.

37. The method for the storage for a firearm assembly of claim 36, wherein said stand-off element is sized such that, when in use and hung from the storage receiver attached to the substantially vertical surface, the major axis of the central extension portion is substantially parallel with the substantially vertical surface.

38. The method for the storage for a firearm assembly of claim 21, wherein said second end further comprises a retaining means which functions to secure the stock/frame assembly to the storage adapter and to secure the storage adapter in a storage position, said storage position being that position in which the major axis of the central extension portion is substantially parallel with the major axis of the barrel element in the firearm assembly.

39. The method for the storage for a firearm assembly of claim 38, wherein said retaining means comprises a strap.

40. The method for the storage for a firearm assembly of claim 39, wherein said strap is fabricated from a material selected from the group consisting of: a hook-and-loop fastener, an elasticized material, and a rubberized material.

* * * * *